US005623793A

United States Patent [19]

Kyomen et al.

[11] Patent Number: 5,623,793

[45] Date of Patent: Apr. 29, 1997

[54] PERMANENT FORM FOR PLACING BASEMENT CONCRETE WALL

[75] Inventors: Junsuke Kyomen; Masayuki Sakaguchi; Michio Watanabe; Kazutaka Takada, all of Sakai; Hiromasa Kawamura, Osaka; Shunji Horinaka, Osaki; Hideaki Iwatake, Osaka; Ryoichi Takesako, Osaka; Shinichiro Takai, Osaka, all of Japan

[73] Assignees: Muramoto Construction Co., Ltd., Kitakatsuragi-gun; Kubota Corporation, Osaka, both of Japan

[21] Appl. No.: 204,301

[22] PCT Filed: Jul. 8, 1993

[86] PCT No.: PCT/JP93/00954

§ 371 Date: Jun. 14, 1994

§ 102(e) Date: Jun. 14, 1994

[87] PCT Pub. No.: WO94/01625

PCT Pub. Date: Jan. 20, 1994

[30] Foreign Application Priority Data

Jul. 9, 1992 [JP] Japan ..... 4-181958
Dec. 2, 1992 [JP] Japan ..... 4-323002

[51] Int. Cl.[6] ..... E02B 11/00; E02D 31/02

[52] U.S. Cl. ..... 52/169.5; 52/506.01; 52/310; 52/508; 52/425; 52/442

[58] Field of Search ..... 52/506.01, 506.02, 52/506.05, 508, 510, 407.1, 407.4, 404.2, 310, 425, 438, 442, 169.5

[56] References Cited

U.S. PATENT DOCUMENTS

| | | | |
|---|---|---|---|
| 3,203,146 | 8/1965 | Carter | 52/310 X |
| 3,654,765 | 4/1972 | Healy et al. | 52/169.5 X |
| 3,965,686 | 6/1976 | Saito et al. | 52/169.5 X |
| 4,333,281 | 6/1982 | Scarfone | 52/169.5 |
| 4,730,953 | 3/1988 | Tarko | 52/169.5 X |
| 4,840,515 | 6/1989 | Freese | 52/169.5 X |
| 4,943,185 | 7/1990 | McGuckin et al. | 52/169.5 X |
| 4,956,951 | 9/1990 | Kannankeril | 52/169.5 |
| 5,035,095 | 7/1991 | Bevilacqua | 52/169.5 |

FOREIGN PATENT DOCUMENTS

| | | |
|---|---|---|
| 3-28670 | 5/1991 | Japan . |
| 3-281863 | 12/1991 | Japan . |
| 4-70467 | 3/1992 | Japan . |

*Primary Examiner*—Wynn E. Wood
*Attorney, Agent, or Firm*—Hoffmann & Baron

[57] ABSTRACT

A permanent form for placing a basement concrete wall includes a percolation layer and a water-conduit channel for discharging water leakage or the like from a basement concrete wall. If the basement concrete wall is placed using the form, the percolation layer is impregnated with cement paste of concrete, whereby the form and the basement concrete wall are joined to each other. Redundant water before hardening the concrete, water leakage after hardening or the like flows into the water-conduit channel through the percolation layer, flows downward through the water-conduit channel, and is discharged from the bottom of the form. In addition, heat from the basement concrete wall is cut off by a heat insulating layer provided on the side of the interior as viewed from the water-conduit channel.

6 Claims, 12 Drawing Sheets

10

10

PERMANENT FORM FOR PLACING BASEMENT CONCRETE WALL

TECHNICAL FIELD

The present invention relates to a permanent form for placing a basement concrete wall. More particularly, the present invention relates to a permanent form which is left integrally with a basement concrete wall placed and can discharge redundant water in a fresh concrete, artesian spring, leakage water or the like through the basement concrete wall.

PRIOR ART

One example of conventional forms for placing an basement concrete wall is disclosed in FIG. 2 in Japanese Utility Model Publication No. 3-28670 published on May 19, 1991. The prior art is so adapted as to affix a sheet having a flute serving as a water-conduit channel and a cloth serving as a percolation layer to a substrate having predetermined strength and using the sheet affixed to the substrate as a concrete form. If a basement concrete wall is placed using this concrete form, redundant water in fresh concrete flows into the flute through the cloth, flows downward through the flute, and is discharged from the bottom of the form before hardening the concrete, so that the hardening rate of the concrete is increased, to improve the surface state and physical properties thereof. After hardening the concrete, the form is removed from the basement concrete wall.

However, there are some problems in the prior art. For example, the sheet must be affixed to the substrate, resulting in poor workability. In addition, the form is removed from the concrete, thereby to make it impossible to prevent the entrance of water leakage into the interior due to, for example, the occurrence of a crack after hardening the concrete.

Therefore, a permanent form having a water-conduit channel, a percolation layer and a substrate integrally formed in advance is disclosed in Japanese Patent Laid-Open Gazette No. 3-281863 laid open on Dec. 12, 1991 and Japanese Patent Laid-Open Gazette No. 4-70467 laid open on Mar. 5, 1992.

According to the prior arts, a sheet need not be affixed to the substrate, thereby to make it possible to improve workability. Moreover, the form need not be removed from the placed concrete, so that water leakage after hardening the concrete can be discharged from the bottom of the form, thereby to make it possible to prevent the entrance of the water leakage into the interior. Since the form is so constructed that the water-conduit channel and the percolation layer are affixed to the substrate, however, there are some problems. Specifically, the function, especially the strength of the form is greatly changed depending on the material of the substrate (veneer or the like). In addition, the strength of the form depends on only the substrate. If an attempt to obtain sufficient strength is made, therefore, the thickness of the entire form is increased and the weight thereof is increased.

SUMMARY OF THE INVENTION

Therefore, a principal object of the present invention is to provide a new permanent form for placing a basement concrete wall.

Another object of the present invention is to provide a permanent form for placing a basement concrete wall capable of improving workability and the leak-prevention function for the basement concrete wall.

Still another object of the present invention is to provide a permanent form for placing a basement concrete wall being lightweight and having practically sufficient strength.

A further object of the present invention is to provide a permanent form for placing a basement concrete wall capable of preventing dew condensation.

A permanent form for placing a basement concrete wall according to the present invention is integrated with a placed basement concrete wall, and has a panel forming a basement concrete wall surface and a water-conduit channel for discharging water from the basement concrete wall which are integrally formed of synthetic resin.

According to the present invention, the panel and the water-conduit channel support a form structure in cooperation, thereby to make it possible to so form the permanent form for placing a basement concrete wall as to be lightweight and have high strength. In addition, the necessity of affixing a sheet to a substrate is eliminated, thereby to make it possible to improve workability.

In accordance with a particular aspect of the present invention, a permanent form for placing a basement concrete wall comprises a percolation layer for absorbing water from a basement concrete wall, a water-conduit channel for discharging water downward, and a heat insulating layer formed integrally with the water-conduit channel and for cutting off heat from the basement concrete wall, which are arranged in this order from the side of the basement concrete wall.

In this aspect, at the time of placing concrete, the percolation layer absorbs redundant water in a fresh concrete. The redundant water absorbed by the percolation layer flows downward through the percolation layer or the water-conduit channel and is discharged from the bottom of the form. After hardening the concrete, the percolation layer and the concrete are firmly integrated with each other to form a wall structure, and water leakage from a crack occurring in the basement concrete wall is discharged similarly to the above described redundant water. Further, heat from the basement concrete wall is cut off by the heat insulating layer. Since heat from the basement concrete wall can be cut off by the heat insulating layer, therefore, it is possible to prevent dew condensation on the surface of the form. If the water-conduit channel and the heat insulating layer are integrally formed of synthetic resin such as polyvinyl chloride, and a foam resin layer or an air layer is used as the heat insulating layer, the form can be so formed as to be more lightweight and have higher strength than the conventional form. Furthermore, if a non-woven fabric is used as the percolation layer, the percolation layer (the non-woven fabric) can be displaced as the basement concrete wall is displaced due to the occurrence of the crack, so that the displacement of the basement concrete wall can be prevented from being transmitted to the form, thereby to make it possible to prevent the form from being cracked, for example.

In a preferred embodiment, the non-woven fabric is used as the percolation layer. However, such a percolation layer may be formed as a synthetic resin layer having percolation holes. In this case, it is desirable to form anchor portions in the form so as to improve joining properties of the form and the basement concrete wall. However, it is possible to improve joining properties of the form and the basement concrete wall even by forming inlets introducing concrete and acceptance portions extending toward the depth from the inlet and accepting the concrete.

If the percolation layer, the water-conduit channel and the heat insulating layer are formed of a transparent member, it is possible to construct the form while confirming the placed state of the concrete by eyes, thereby to make it possible to improve workability.

In accordance with another aspect of the present invention, a permanent form for placing a basement concrete wall comprises a water-conduit channel for absorbing water from a basement concrete wall as well as discharging the water downward, and a heat insulating layer for cutting off heat from the basement concrete wall which are arranged in this order from the side of the basement concrete wall.

Consequently, in this aspect, the percolation layer and the water-conduit channel need not be separately formed, thereby to make it possible to simply manufacture the form.

The foregoing and other objects, features, aspects and advantages of the present invention will become more apparent from the following detailed description of the present invention when taken in conjunction with the accompanying drawings.

BEST MODE FOR CARRYING OUT THE INVENTION

Figure 1:
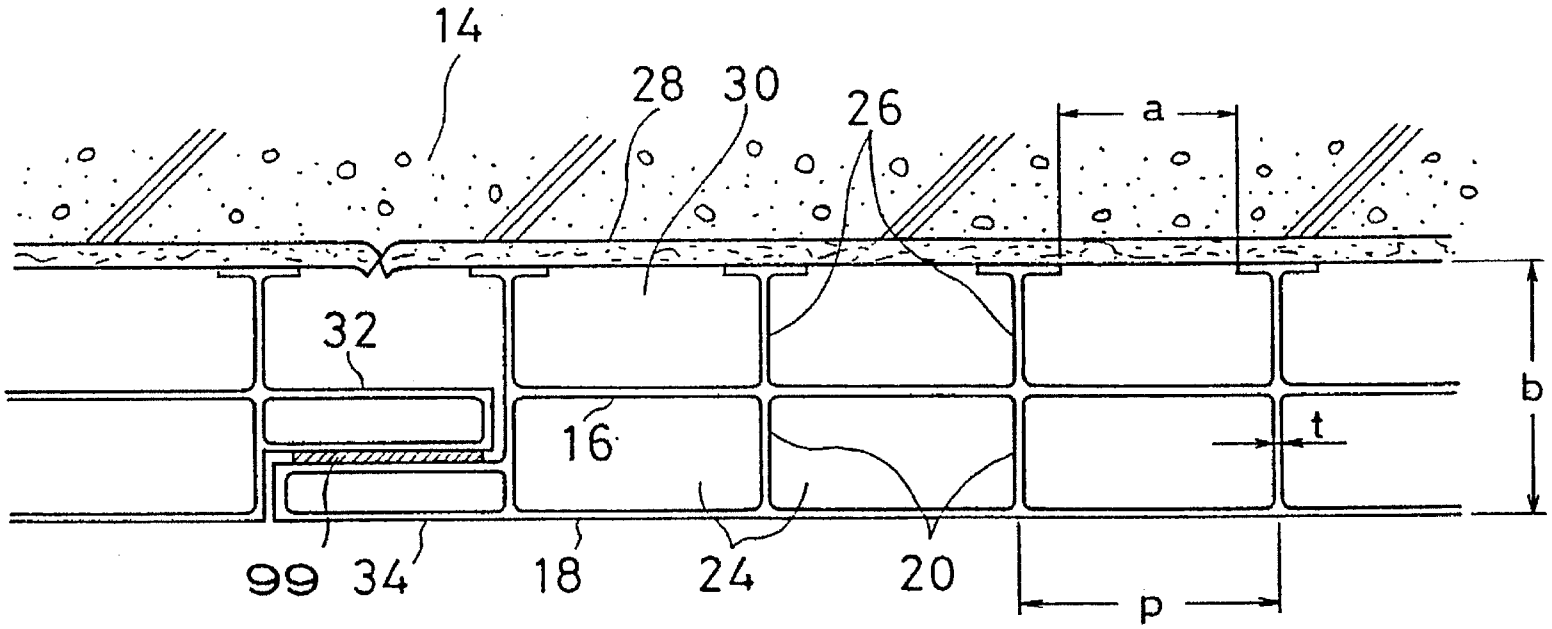
FIG. 1 is an illustration showing one embodiment of the present invention.
Figure 2:
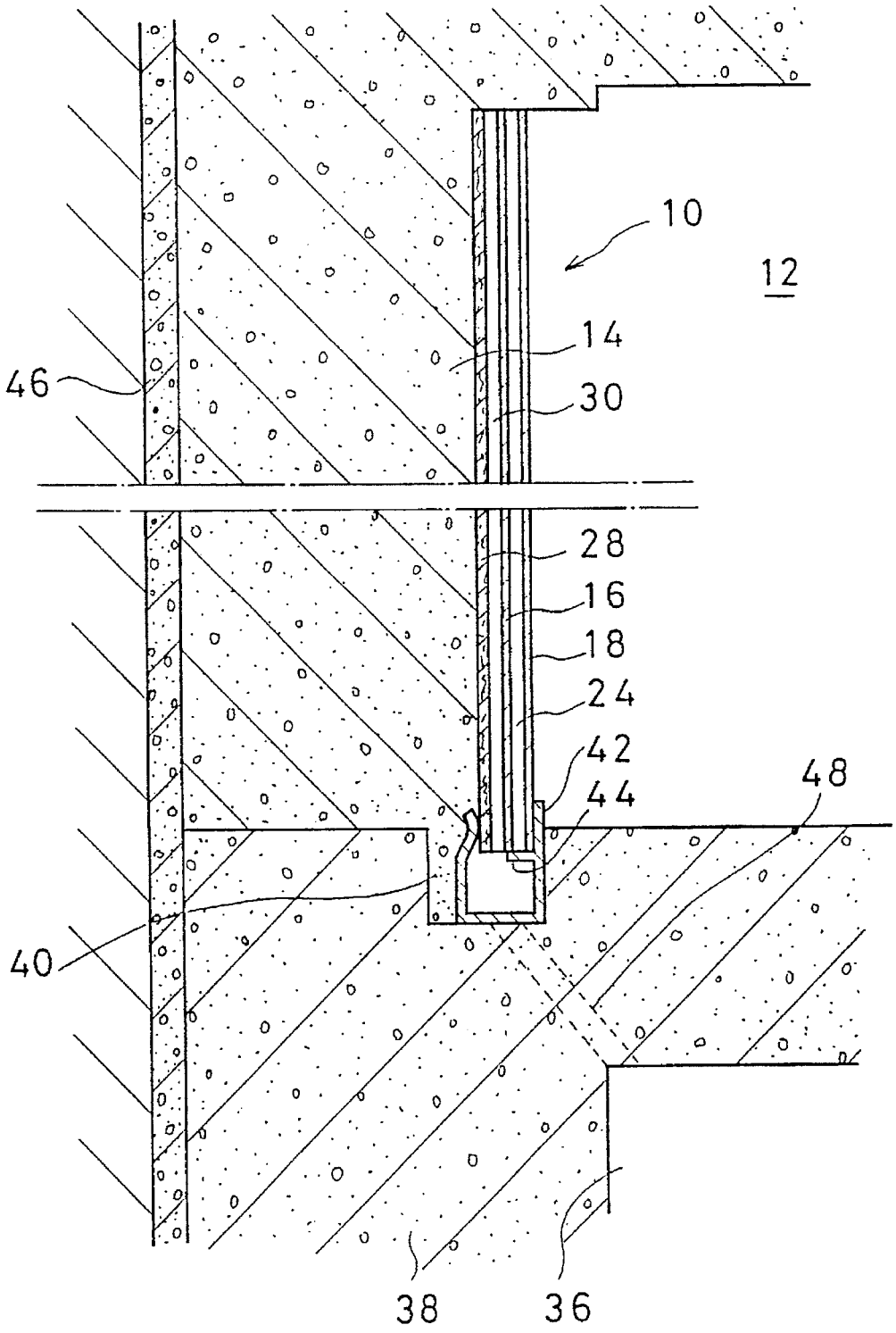
FIG. 2 is an illustration showing the use state of the embodiment shown in FIG. 1.
Figure 3:
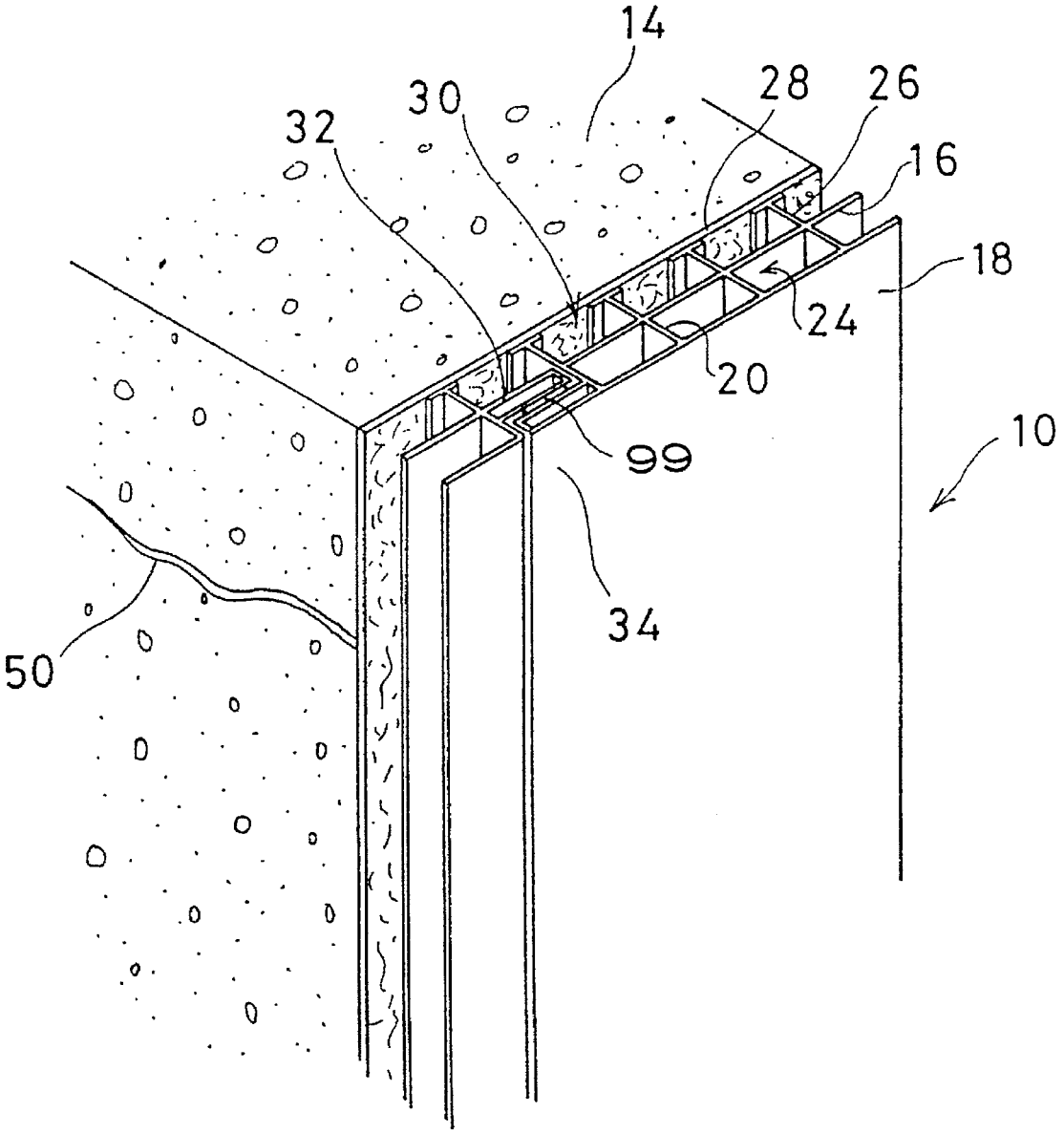
FIG. 3 is a perspective view showing the use state of the embodiment shown in FIG. 1.

Referring to FIGS. 1 to 3, a form 10 in this embodiment shown is for placing a basement concrete wall 14 of a basement (FIG. 2), and comprises a first panel 16 and a second panel 18 which are arranged parallel to each other. The first panel 16 and the second panel 18 are connected to each other by a plurality of ribs 20 extending in the longitudinal direction. Air layers each formed by the first panel 16, the second panel 18 and the ribs 20 connect with each other in the transverse direction, to be a heat insulating layer 24. In addition, a plurality of supporting members or pieces 26, which are in a substantially T shape in cross section, extending in the longitudinal direction are formed for each spacing on a major surface on the side of the basement concrete wall 14 of the first panel 16, and a percolation layer 28 such as a non-woven fabric is affixed to ends of the supporting members 26. A space enclosed by the supporting members 26, the first panel 16 and the percolation layer 28 becomes a water-conduit channel 30. A first engaging member or piece 32 and a second engaging member or piece 34 are respectively formed in one end and the other end of the heat insulating layer 24 so as to be connectable to another form 10. A slit width a, a thickness b, a rib pitch P and a rib thickness t are respectively set to 12.5 mm, 32 mm, 25 mm and 1 mm. The first panel 16, the second panel 18, the ribs 20 and the supporting members 26 are integrally formed by extrusion of hard synthetic resin which is low in thermal conductivity such as polyvinyl chloride.

Referring to FIG. 2, when the basement concrete wall 14 is placed, a drainage ditch 40 is first formed on the upper surface of a slab 38 having an artesian spring tank 36 formed in its part, and a water channel 42 is located in the drainage ditch 40. The form 10 is assembled on the water channel 42 so that its bottom surface abuts against a stopper 44 of the water channel 42. At this time, a first engaging member 32 of one form 10 and a second engaging member 34 of another form 10 are joined to each other by a waterproofed double-faced tape 99 such as a butyl rubber tape, as can be seen from FIGS. 1 and 3. The basement concrete wall 14 is placed between the form 10 and a sheathing basement concrete wall 46. If the basement concrete wall 14 is placed, the percolation layer 28 is impregnated with cement paste of concrete, whereby the basement concrete wall 14 and the form 10 are firmly joined to each other without using a special joining member after hardening the concrete.

Before hardening the basement concrete wall 14, redundant water in the concrete flows into the water-conduit channel 30 through the percolation layer 28, flows downward through the water-conduit channel 30, and is discharged to the artesian spring tank 36 through the water channel 42 and a water pipe 48 provided in the slab 38. On the other hand, after hardening the basement concrete wall 14, water leaking out to the surface of the basement concrete wall 14 through a crack 50 (FIG. 3) occurring in the basement concrete walls 14 and 46 is discharged to the artesian spring tank 36 similarly to the previous redundant water. When the surface of the basement concrete wall 14 is displaced due to, for example, the occurrence of the crack 50, the percolation layer 28 is displaced with the displacement. Consequently, the displacement is prevented from being transmitted to a main body of the form 10, thereby to prevent the form 10 from being cracked or bent, for example. The percolation layer 28 also functions as a cushioning layer.

Furthermore, heat from the basement concrete wall 14 is cut off by the heat insulating layer 24. Consequently, dew condensation on the surface of the form 10 (the second panel 18) is not brought about.

Figure 4:
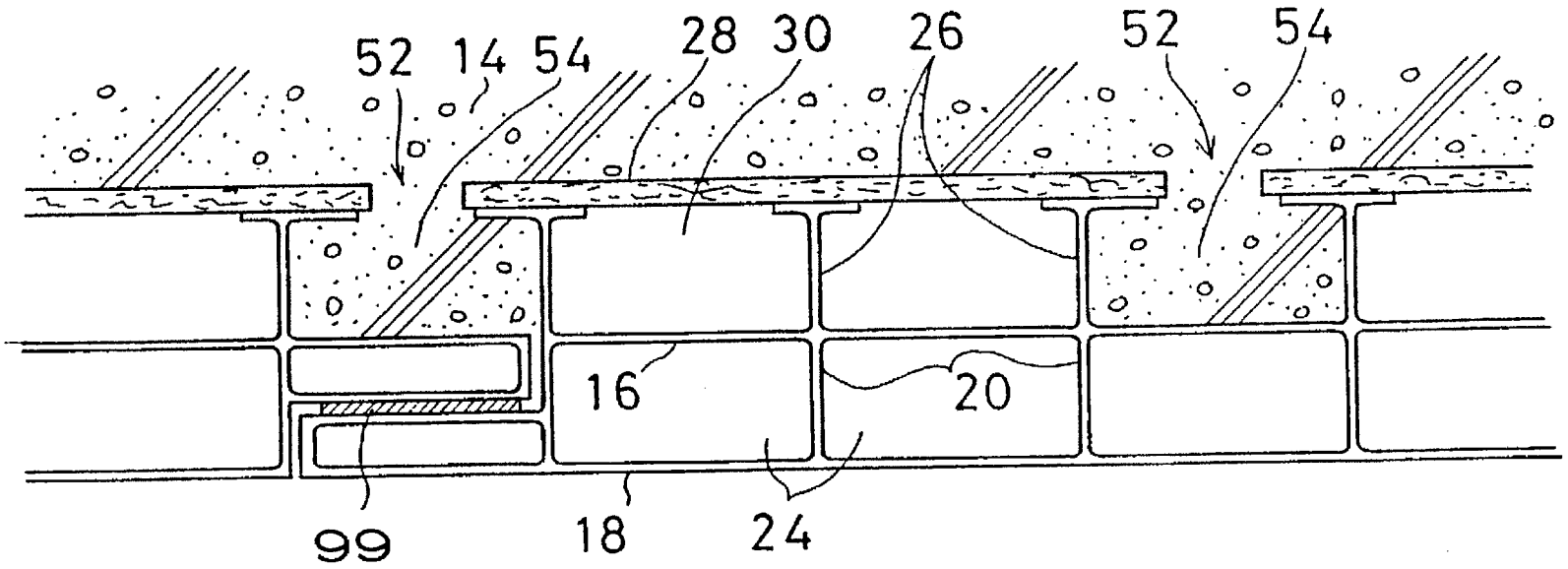
FIG. 4 is an illustration showing a state where an inlet and a reservoir portion are formed in the embodiment shown in FIG. 1.

As shown in, for example, FIG. 4, if an inlet 52 introducing concrete is formed in the percolation layer 28 and a reservoir portion 54 is formed so as to expand toward the depth from the inlet 52 so that concrete placed is accumulated in the reservoir portion 54, the basement concrete wall 14 and the form 10 can be joined to each other more firmly.

Figure 5:
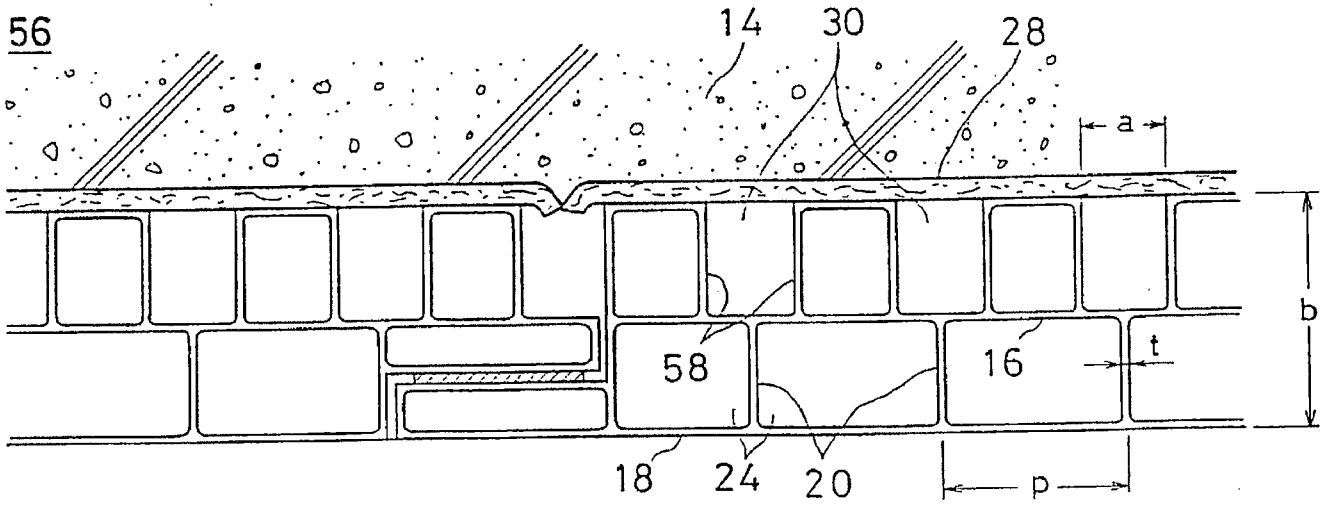
FIG. 5 is an illustration showing another embodiment of the present invention.

In a form 56 according to another embodiment shown in FIG. 5, a plurality of hollow blocks 58 extending in the longitudinal direction are formed for each predetermined spacing in place of the supporting members or pieces 26 in the above described embodiment, and a percolation layer 28 such as a non-woven fabric is affixed to a major surface on the side of a basement concrete wall 14 of each of the blocks 58. A space enclosed by a first panel 16, the blocks 58 and the percolation layer 28 becomes a water-conduit channel 30. A slit width a, a thickness b, a rib pitch P and a rib thickness t are respectively set to, for example, 12.5 mm, 32 mm, 25 mm and 1 mm.

Also in the present embodiment, the first panel 16, a second panel 18, ribs 20 and the blocks 58 are integrally formed by extrusion of synthetic resin such as polyvinyl chloride. However, more stable forming is structurally possible, as compared with the previous embodiment.

Figure 6:
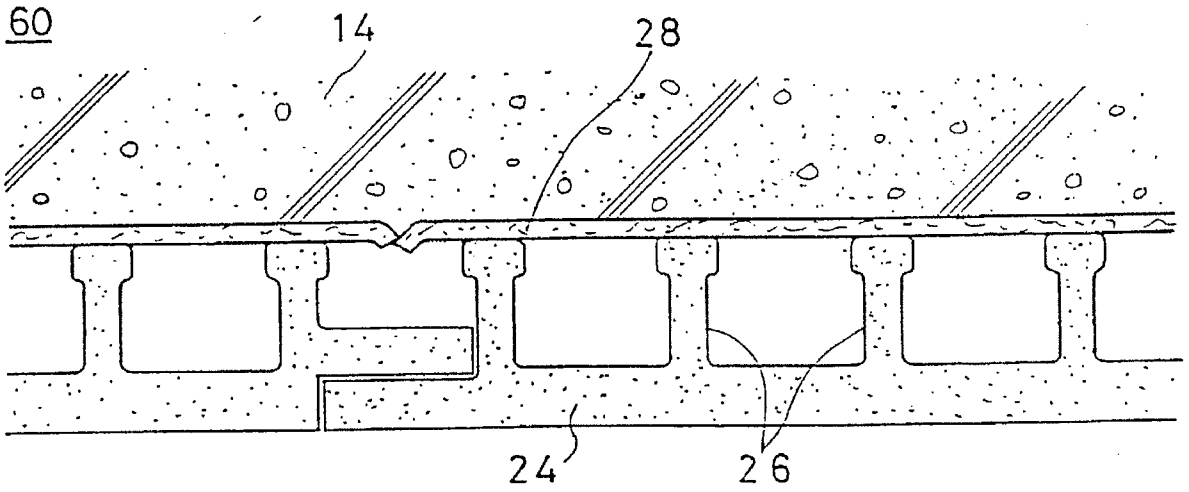
FIG. 6 is an illustration showing another embodiment of the present invention.

Although in the above described embodiments, a heat insulating layer 24 is formed by an air layer, a heat insulating layer 24 (and supporting members or pieces 26) may be formed of foam synthetic resin such as foam hard polyvinyl chloride as in, for example, a form 60 shown in FIG. 6. This form 60 allows an interior finish to be nailed on an inner surface of the form 60 more firmly.

Figure 7:
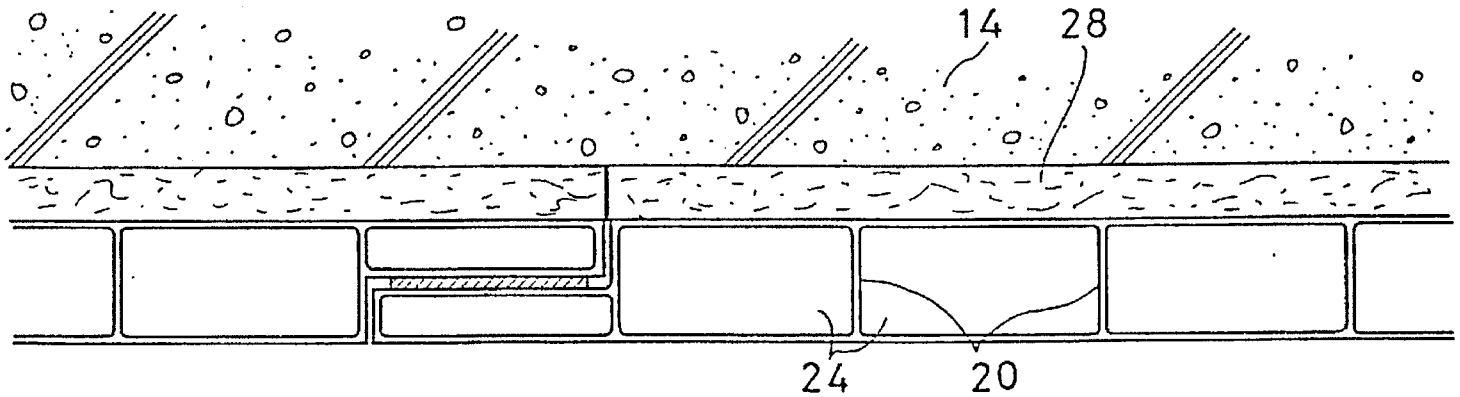
FIG. 7 is an illustration showing another embodiment of the present invention.

Furthermore, a percolation layer 28 such as a non-woven fabric may be so formed as to be relatively thick as in, for example, a form 62 shown in FIG. 7 so that redundant water, water leakage or the like from a basement concrete wall 14 is absorbed by the percolation layer 28 and at the same time, flows downward through the percolation layer 28, and is discharged from the bottom of the form 62. This form 62 eliminates the necessity of forming a water-conduit channel, thereby to make it possible to simplify the structure and reduce the manufacturing cost.

Figure 8:
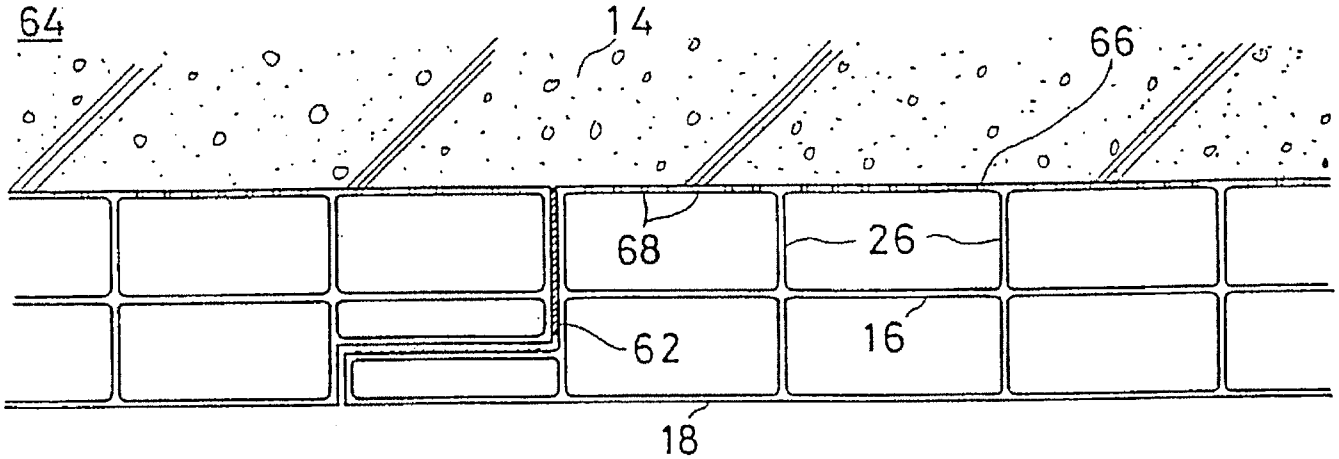
FIG. 8 is an illustration showing another embodiment of the present invention.

A third panel 66 may be formed integrally with supporting members or pieces 26 (or blocks 58) and provided with a plurality of percolation holes 68 to be a percolation layer as in, for example, a form 64 shown in FIG. 8. This form 64 eliminates the necessity of affixing a non-woven fabric in the subsequent process, thereby to make it possible to simplify the manufacturing processes.

Figure 9:
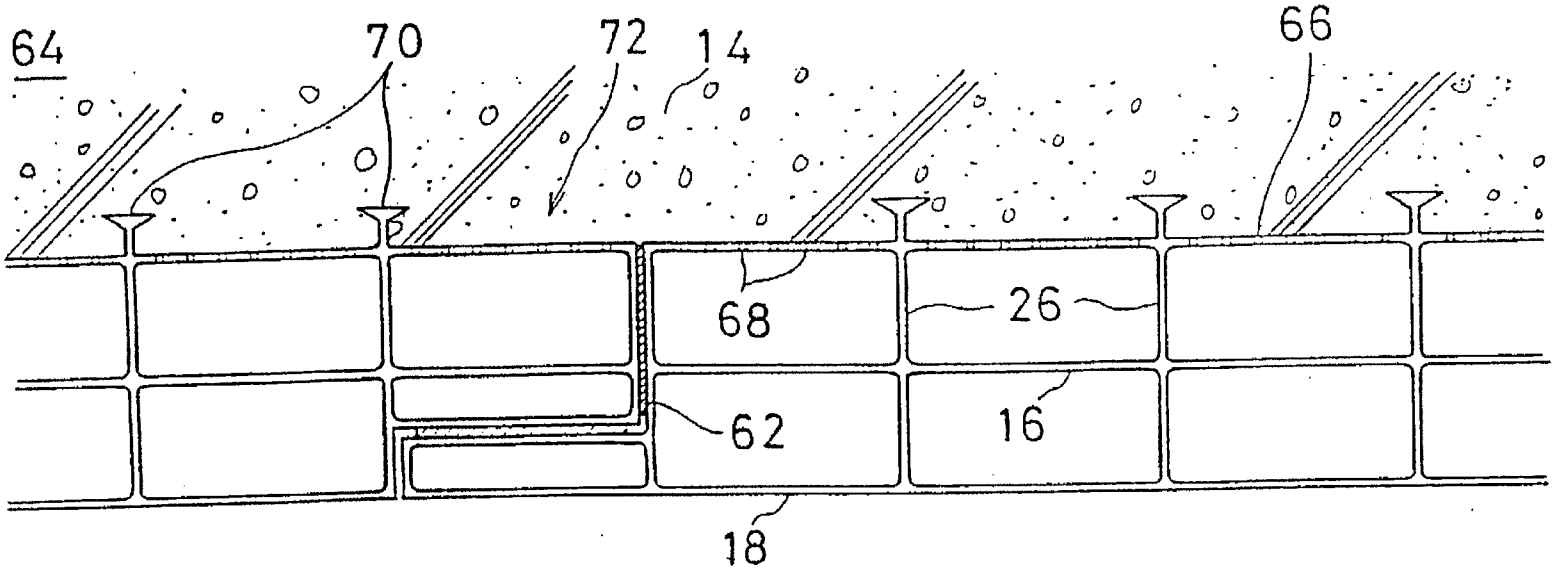
FIG. 9 is an illustration showing a state where an anchor portion is formed in the embodiment shown in FIG. 8.
Figure 10:
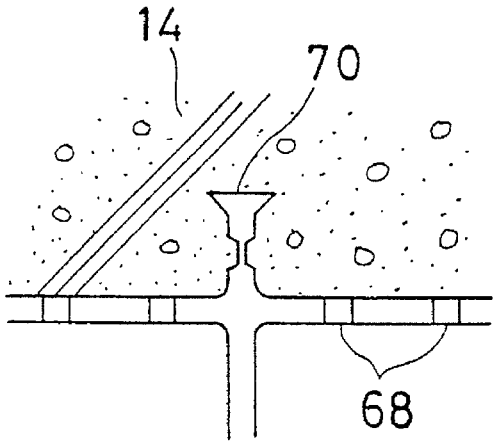
FIG. 10 is an illustration showing a modified example of the anchor portion.
Figure 11:
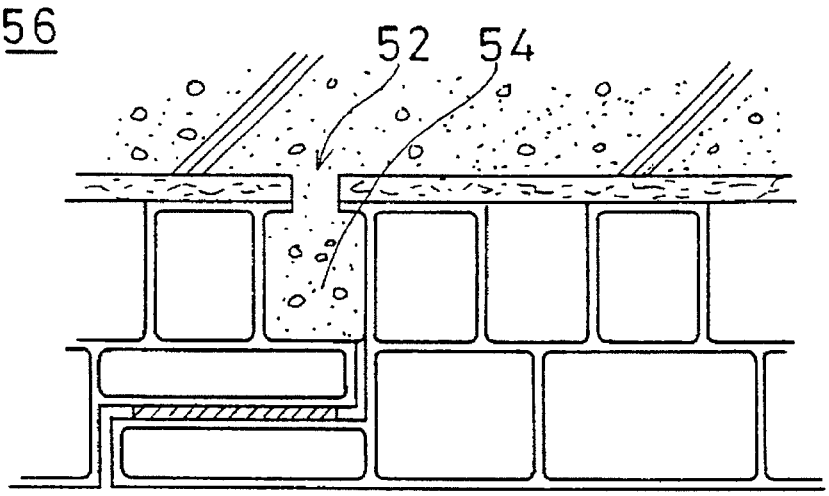
FIG. 11 is an illustration showing a state where an inlet and a reservoir portion are formed in the embodiment shown in FIG. 5.
Figure 12:
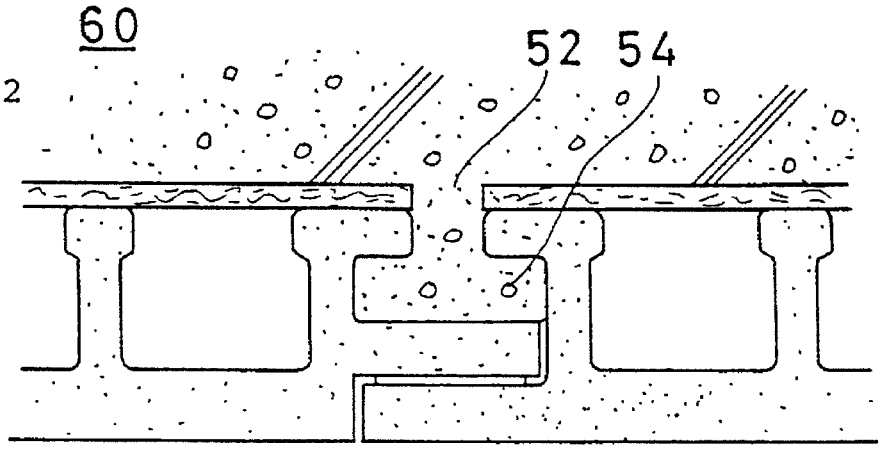
FIG. 12 is an illustration showing a state where an inlet and a reservoir portion are formed in the embodiment shown in FIG. 6.
Figure 13:
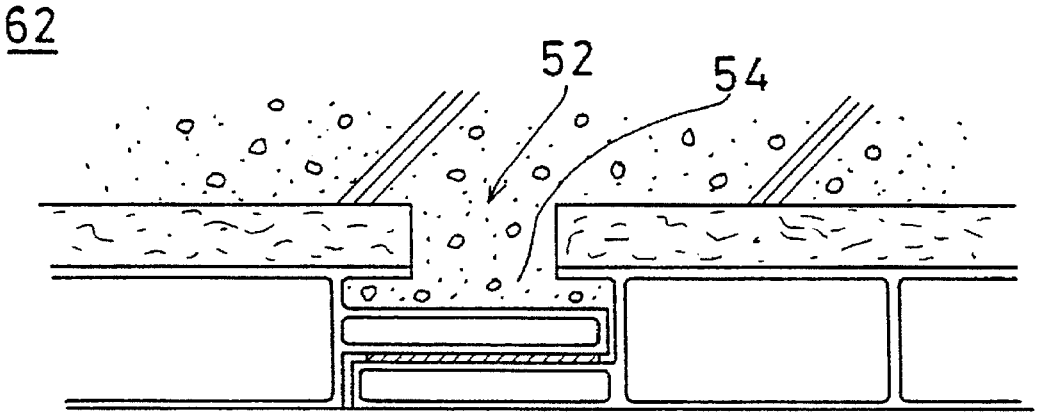
FIG. 13 is an illustration showing a state where an inlet and a reservoir portion are formed in the embodiment shown in FIG. 7.
Figure 14:
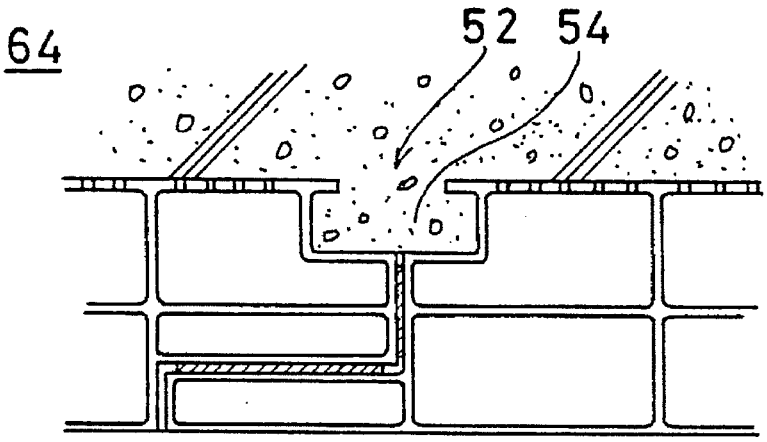
FIG. 14 is an illustration showing a state where an inlet and a reservoir portion are formed in the embodiment shown in FIG. 8.

Furthermore, an anchor portion 70 embedded in a basement concrete wall 14 may be formed on a major surface on the side of the basement concrete wall 14 of a third panel 66 as in a form 64 shown in FIG. 9 to improve joining properties of the form 64 and the basement concrete wall 14. If a crack 50 (FIG. 3) occurs in the basement concrete wall 14, the position of the anchor portion 70 is shifted. If a form body 72 follows the shift, the form 64 is liable to be cracked. In order to prevent the form body 72 from following the shift of the anchor portion 70, therefore, the anchor portion 70 is formed of a soft material such as an elastomer or soft polyvinyl chloride or is formed into a structure which can be easily cut as shown in FIG. 10. If the anchor portion 70 is formed of the soft material, both the soft material of the anchor portion 70 and a hard material of the form body 72 are extruded (are subjected to tow-layer extrusion).

Furthermore, a first panel 16, a second panel 18, the third panel 66 and the like in the form 64 (FIGS. 8 and 9) may be formed of a transparent material such as polycarbonate or acrylic resin. If they are formed of a transparent material, the form 64 can be constructed while confirming the placed state of concrete from the side of the interior, thereby to make it possible to rapidly improve workability as well as improve joining properties to the basement concrete wall 14.

Also in the forms 56, 60, 62 and 64, an inlet 52 and a reservoir portion 54 may be formed to improve joining properties to the basement concrete wall 14, as shown in, for example, FIGS. 11 to 14.

Additionally, an interior finish such as a gypsum board or a the may be mounted as required on a major surface on the side of the interior of the heat insulating layer 24 in each of the above described embodiments using a nail, adhesives or the like in advance or after the construction.

The results of flexural rigidity (E·I) and maximum allowable bending moment (f·Z) found with respect to the present form and the form 10 (FIG. 1) and the form 56 (FIG. 5) according to the embodiments are summarized in Table 1.

TABLE 1

| Kinds of Forms | Conventional Form | Form 10 (FIG. 1) | | | | | | Form 56 (Fire 5) | | |
|---|---|---|---|---|---|---|---|---|---|---|
| Material | Veneer | PVC | | | | | | PV | PVC | |
| Slit width a(mm) | — | 12.5 | 12.5 | 10 | 15 | 15 | 10 | 12.5 | 12.5 | 15 |
| Thickness (mm) | 12 | 32 | 32 | 32 | 32 | 32 | 32 | 32 | 32 | 32 |
| Rib pitch (mm) | — | 25 | 25 | 25 | 25 | 30 | 20 | 25 | 25 | 25 |
| Thickness of (mm) resin | — | 1 | 0.8 | 1 | 1 | 1 | 1 | 1 | 1 | 1 |
| Weight (kg/m$^2$) | 7.2 | 5.2 | 4.2 | 5.4 | 5.1 | 4.9 | 5.7 | 4.5 | 6.1 | 5.9 |
| E · I (kg · cm$^2$) | 10.000 | 12.800 | 10.500 | 13.700 | 11.900 | 12.300 | 13.600 | 10.600 | 14.500 | 13.700 |
| f · Z (kg · cm) | 58 | 97 | 79 | 103 | 90 | 93 | 102 | 131 | 110 | 104 |

PVC Poly vinyl Chloride
PC Polycarbonate

The strength of the form is generally evaluated by deflection δ at the time of placing which is represented by an equation 1 and maximum allowable bending moment M which is represented by an equation 2.

$$\delta = \frac{5Wl^4}{384 \cdot E \cdot I} \quad (1)$$

W: maximum side pressure at the time of placing concrete l: spacing between battens E: Young's modulus of form I: geometrical moment of inertia of form $$M=f\cdot Z \quad (2)$$

f: maximum allowable bending stress

Z: modulus of section of form

If E·I and f·Z in a certain form are not less than E·I and f·Z in the present form from the equations 1 and 2, it can be judged that the form has practically sufficient strength. As can be seen from Table 1, therefore, the form 10 (FIG. 1) and the form 56 (FIG. 5) allow practically sufficient strength to be ensured by suitably setting the size or the material. In addition, the forms can be rapidly made more lightweight than the present form. It goes without saying that the forms 60, 62 and 64 shown in FIGS. 6 to 8 allow sufficient strength to be ensured by suitably setting the size or the material.

Figure 15:
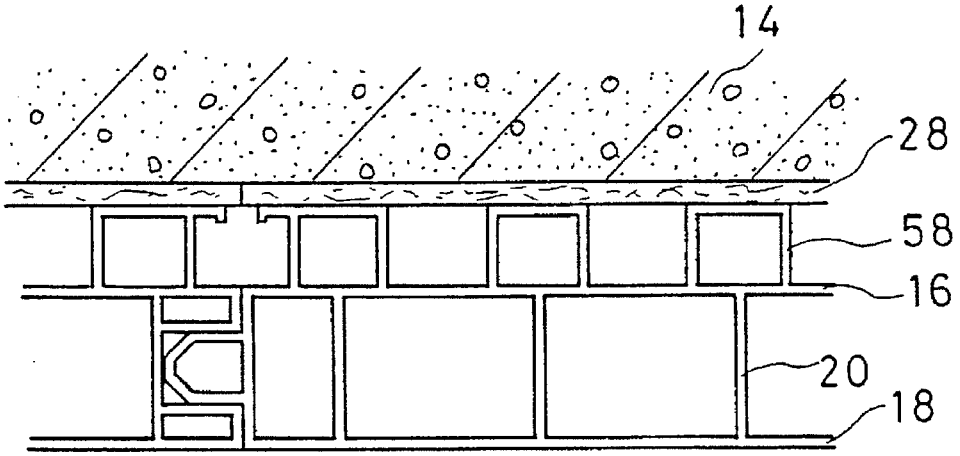
FIG. 15 is an illustration showing a further embodiment of the present invention.
Figure 16:
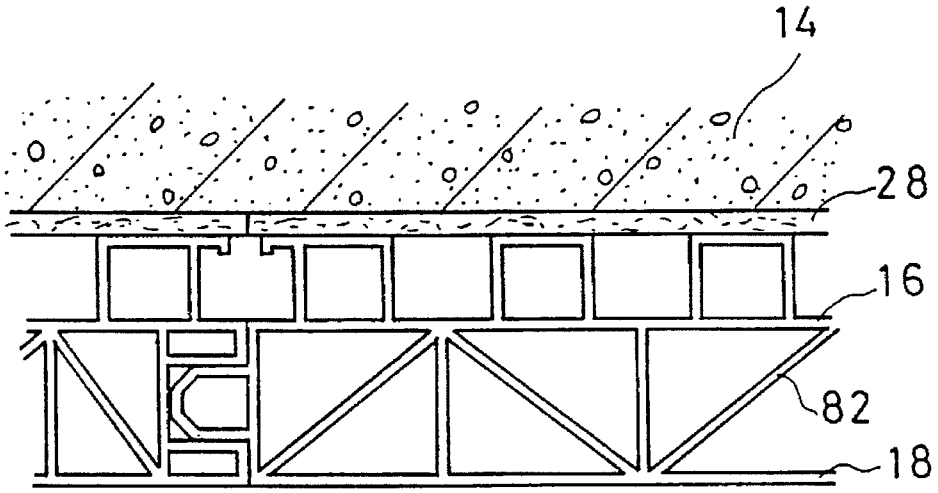
FIG. 16 is an illustration showing a further embodiment of the present invention.
Figure 17:
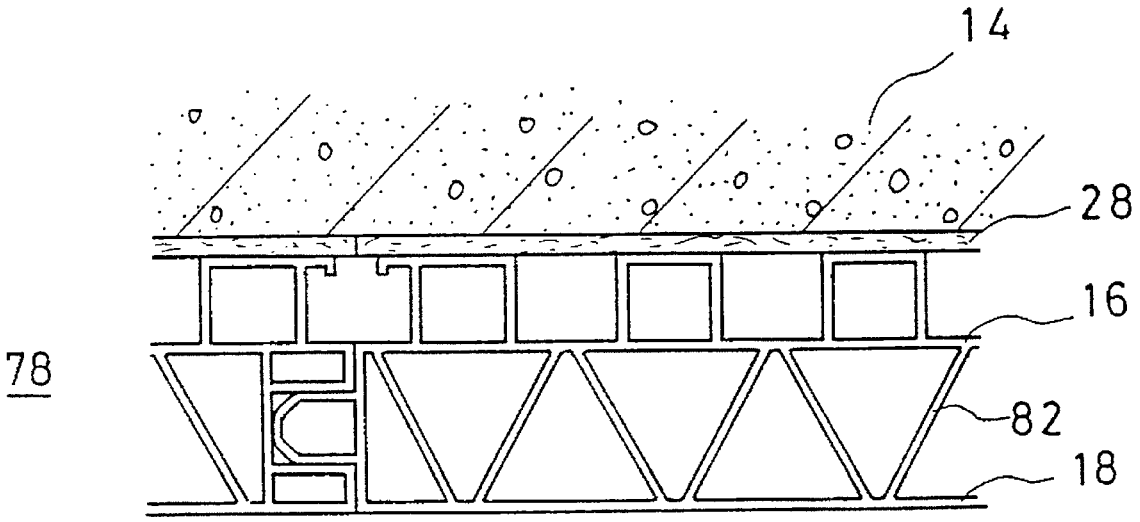
FIG. 17 is an illustration showing a further embodiment of the present invention.
Figure 18:
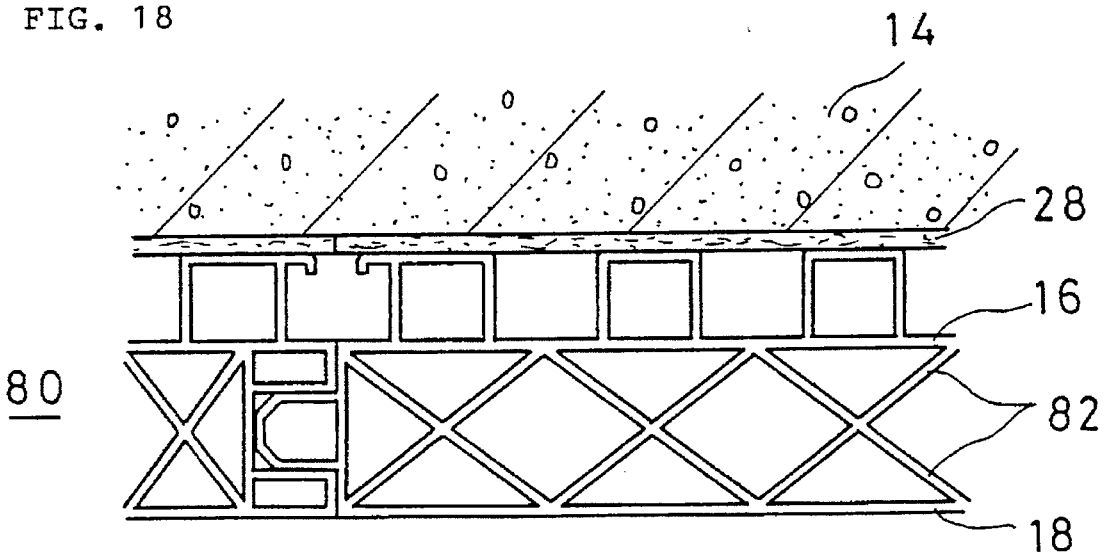
FIG. 18 is an illustration showing a further embodiment of the present invention.

Although in the form 58 shown in FIG. 5, the plurality of hollow blocks 58 extending in the longitudinal direction are formed between the ribs 20, such hollow blocks 58 may be formed in positions laid across a rib 20 as in, for example, a form 74 shown in FIG. 15. Further, in order to increase the strength particularly in the transverse direction of a form, a rib 82 for obliquely connecting a first panel 16 and a second panel 18 to each other may be formed as in, for example, forms 76, 78 and 80 respectively shown in FIGS. 16 to 18. The form 76 shown in FIG. 16 is a form in which such a rib 82 is added in the form 56 shown in FIG. 5, the form 78 shown in FIG. 17 is a form in which such a rib 82 is formed in a substantially V shape, and the form 80 shown in FIG. 18 is a form in which such a rib 82 is formed in a substantially X shape.

The results of flexural rigidity in the longitudinal direction E·Ix (kg·cm$^2$), flexural rigidity in the transverse direction E·Iz (kg cm$^2$) and weight (W kg/m$^2$) respectively found with respect to the form 74 (FIG. 15), the form 76 (FIG. 16), the form 78 (FIG. 7) and the form 80 (FIG. 18) as in Table 1 are summarized in Table 2. Apparent flexural rigidity is found by bending tests as the flexural rigidity in the transverse direction.

TABLE 2

| | Form 74 | Form 76 | Form 78 | Form 80 |
|---|---|---|---|---|
| E · Ix | 14,200 | 15,800 | 15,600 | 16,400 |
| (kg · cm$^2$) | (1) | (1.11) | (1.09) | (1.15) |
| E · Iz | 23.4 | 1,280 | 1,290 | 1,790 |
| (kg · cm$^2$) | (1) | (54.6) | (55) | (76.5) |
| Weight | 6.1 | 7.7 | 7.4 | 8.2 |
| W kg/m$^2$ | (1) | (1.26) | (1.21) | (1.34) |

As can be seen from Table 2, it is possible to significantly increase the strength in the transverse direction of the form by forming the rib 82 for obliquely connecting the first panel 16 and the second panel 18 to each other.

Figure 19:
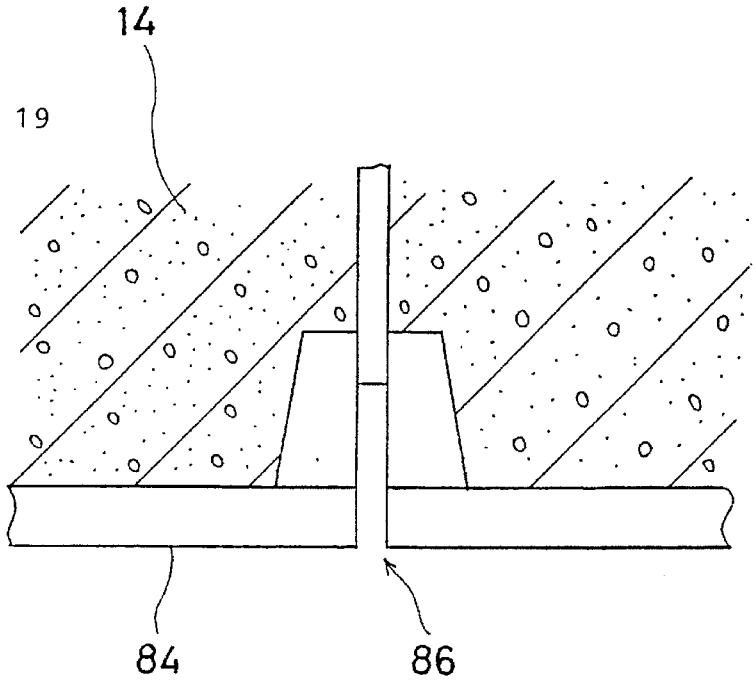
FIG. 19 is an illustration showing a further embodiment of the present invention.
Figure 20:
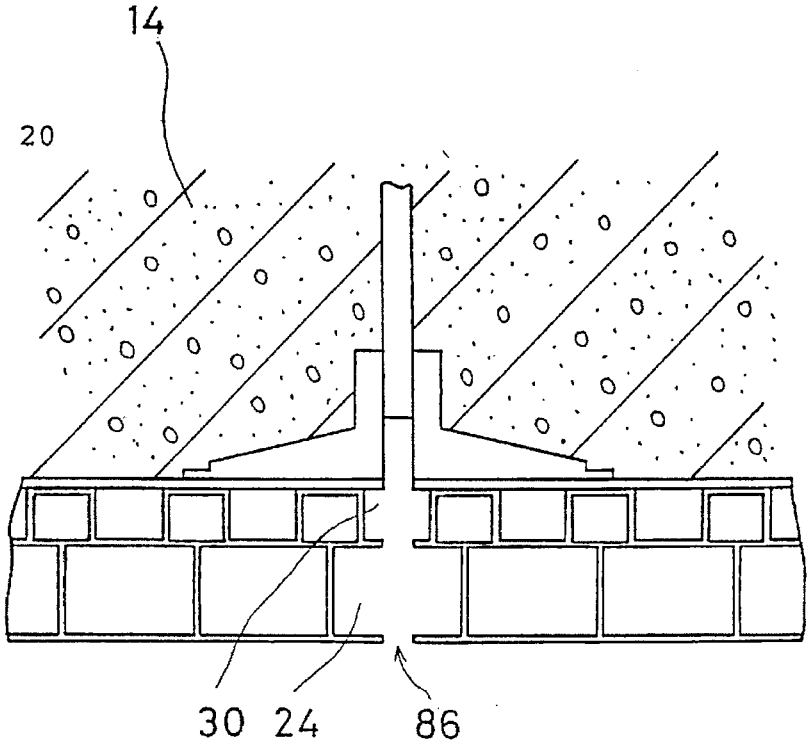
FIG. 20 is an illustration showing yet a further embodiment of the present invention.

Furthermore, in a conventional permanent form for placing, water from a basement concrete wall 14 is liable to leak out to the interior through a separator hole 86 left in a form 84, as shown in, for example, FIG. 19. In the form according to the present invention, however, water drops in a hollow portion such as a water-conduit channel 30 or a heat insulating layer 24, as shown in FIG. 20, so that such a leak of water does not develop.

Although the present invention has been described and illustrated in detail, it is clearly understood that the same is by way of illustration and example only and is not to be taken by way of limitation, the spirit and scope of the present invention being limited only by the terms of the appended claims.

What is claimed:

1. In combination:

a basement concrete wall; and a permanent form which is utilized for placing said basement concrete wall and is integrated with said basement concrete wall when said wall is placed, said permanent form comprising:

a panel for forming a surface of said basement concrete wall;

water-conduit channel for discharging water from said basement concrete wall, said panel and said channel being integrally formed of synthetic resin, said panel and said channel forming a main body of said form; and a cushioning layer interposed between said main body and said basement concrete wall, said cushioning layer being displaced as said basement concrete wall undergoes displacement to prevent said displacement of said basement concrete wall from being transmitted to said main body so as to prevent cracking or bending of said main body of said form caused by said displacement of said basement concrete wall, said cushioning layer being formed of a non-woven fabric selected for cushioning of said main body.

2. In combination:

a basement concrete wall; and a permanent form which is utilized for placing said basement concrete wall and is integrated with said basement concrete wall when said wall is placed, said wall having an inside and an outside, said permanent form comprising:

a porous percolation layer for absorbing water from said basement concrete wall;

a water-conduit channel for discharging said water downward; and a heat insulating layer formed integrally with said water-conduit channel for cutting off heat from said basement concrete wall, said porous percolation layer being located adjacent said inside of said basement concrete wall, said water-conduit channel being located inwardly from said percolation layer, said heat insulating layer being located inwardly from said water-conduit channel, said percolation layer, said water-conduit channel and said heat insulating layer being transparent.

3. In combination:

basement concrete wall; and a permanent form which is utilized for placing said basement concrete wall and is integrated with the basement concrete wall when said wall is placed, the wall having an inside and an outside, said permanent form comprising:

a first panel having a first side with a major surface disposed opposite said inside of said basement concrete wall;

a second panel arranged parallel to and spaced apart from said first panel;

a plurality of ribs for connecting said first and second panels to each other;

a plurality of hollow blocks extending in the longitudinal direction on said major surface of said first side of said first panel, said blocks being formed at predetermined spacings; and a non-woven fabric affixed to said hollow blocks for blocking up spaces formed between said plurality of hollow blocks.

4. In combination;

a concrete wall; and a permanent form by which said concrete wall is placed and which becomes a wall surface of the concrete wall, said permanent form comprising:

a plate having first and second main surfaces;

a plurality of first ribs having ends, each of said ribs extending in a first direction and being arranged on said first main surface of the plate at intervals measured in a second direction intersecting the first direction, said first ribs defining a plurality of first longitudinal spaces; and a percolation and cushioning layer attached to ends of the first ribs and covering the first longitudinal spaces, said percolation and cushioning layer being displaced as said concrete wall undergoes displacement to prevent said displacement of said concrete wall from being transmitted to said ribs and said plate so as to prevent cracking or bending of said ribs and said plate caused by said displacement of said concrete wall, said percolation and cushioning layer being formed of a non-woven fabric selected for cushioning of said ribs and said plate.

5. In combination:

a concrete wall; and permanent form by which said concrete wall is placed and which becomes a wall surface of the concrete wall, said permanent form comprising:

a plate having first and second main surfaces;

a plurality of first ribs having ends, each of said ribs extending in a first direction and being arranged on a first main surface of the plate at intervals measured in a second direction intersecting the first direction, said first ribs defining a plurality of first longitudinal spaces;

a percolation and cushioning layer attached to ends of the first ribs and covering the first longitudinal spaces; and a plurality of second ribs arranged on said second main surface of the plate such that a plurality of longitudinal second spaces are defined by the second fibs.

6. In combination:

a concrete wall; and a permanent form which is utilized for placing said concrete wall and is integrated with the concrete wall, said concrete wall having an inside and an outside, said permanent form comprising:

a first plate having a first surface facing said concrete wall and having a second surface;

a plurality of ribs having ends and being arranged on said first surface of the first plate and extending towards said inside of said concrete wall for forming a plurality of first spaces substantially extending in a longitudinal direction, said first spaces being opened at said inside of the concrete wall;

a second plate arranged in parallel with the first plate and coupled to the second surface of said first plate by connection portions which form a plurality of second spaces substantially extending in the longitudinal direction between the first plate and the second plate; and a percolation and cushioning layer attached to said ends of the ribs to cover the first spaces.

* * * * *